United States Patent [19]

Fitzpatrick et al.

[11] 4,386,980

[45] Jun. 7, 1983

[54] PRODUCTION OF QUILTING PIECEWORK

[75] Inventors: Elizabeth M. D. Fitzpatrick, McMahon's Point; Matthew F. Fitzpatrick, Darlinghurst, both of Australia

[73] Assignee: Marguerite Trading Co. Pty. Limited, Sydney, Australia

[21] Appl. No.: 207,189

[22] Filed: Nov. 14, 1980

[30] Foreign Application Priority Data

Jul. 23, 1980 [AU] Australia ..... PE4665

[51] Int. Cl.[3] ..... B32B 7/08; B32B 31/10

[52] U.S. Cl. ..... 156/63; 112/402; 112/117; 156/93; 156/250; 156/265; 156/304.1; 428/57; 428/102

[58] Field of Search ..... 156/63, 93, 250, 265, 156/304.1; 428/102, 57; 112/402, 425, 269.1, 117, 401, 424

[56] References Cited

U.S. PATENT DOCUMENTS 1,956,594 5/1934 Rindskopf ..... 428/57

3,071,777 1/1963 Miller ..... 112/401

*Primary Examiner*—Paul J. Thibodeau

*Attorney, Agent, or Firm*—Kenyon and Kenyon

[57] ABSTRACT

Disclosed are a method for forming a quilt and a sheet of backing material from which backing pieces used in the method can be separated. The backing sheet has a plurality of outlines of one or more predetermined designs on one face and an adhesive on the other face. Each outline corresponds to a backing piece. The backing pieces are cut from the sheet of backing material and adhered to respective fabric pieces. Each fabric piece and adhered backing piece is cut along the predetermined outline into a predetermined design of the respective backing piece to form respective quilting pieces. Two quilting pieces are placed in a face to face overlapping relationship with edge portions of the two quilting pieces which are intended to be joined adjacent to each other and, in the case of curved edge portions, confronting each other. The two quilting pieces are temporarily secured together along a predetermined seam line by pinning or tacking, for example. When the extreme positions of the seam lines are secured, one of the quilting pieces becomes folded back on itself. The two secured quilting pieces are then sewn along the seam line. Further quilting pieces are applied to the two sewn pieces in like manner.

9 Claims, 3 Drawing Figures

PRODUCTION OF QUILTING PIECEWORK

BACKGROUND OF THE INVENTION

This invention relates to the production of quilts and more particularly to the forming of the quilt covers, commonly referred to as piecework.

A great deal of skill and time is presently required in the quilting craft. The piecework involved frequently employs a variety of colors and texture of otherwise scrap fabric pieces which are color selected and all cut to the outline of a single key design, the pieces of which may be assembled in a variety of ways to achieve an intricate overall design. On occasions several key designs may be employed.

More important aspects of the craft where extreme care must be exercised are uniformity of seaming width and non-stretching and non-puckering of the fabric on the seam line. These aspects become far more difficult to master where curved edges are provided in the design. It is conventional practice to align the lateral edge of the sewing machine shoe with an edge of the fabric as a guide for uniform seaming, and carefully to adjust the tension of the sewing machine on the fabric to avoid puckering. A most tedious aspect is the present requirement of applying by stencil an outline of the design upon the back of each fabric piece.

OBJECT AND SUMMARY OF THE INVENTION

It is a principal object of the invention to provide an improved method of producing piecework for quilt covering.

According to one general form of the invention there is provided a method of producing quilting piecework comprising separating a sheet of backing material, adhesive-coated on one face and carrying a plurality of outlines of one or more predetermined designs, into backing pieces each carrying the outline of a single design, adhering said backing pieces to selected pieces of quilting material, cutting both said backing pieces and said adhered quilting pieces to the design outlines, placing the confronting marginal edge portions of intended adjacent quilting pieces in overlapping relationship, pinning or tacking together along a predetermined seam line said overlapping marginal edge portions, sewing together said quilting pieces along said seam line, straightening said adjacent pieces into coplaner relationship, and proceeding to apply further quilting pieces thereto to obtain completed quilting piecework.

More particularly, a method of forming a quilt according to the invention comprises the steps of adhering a plurality of backing pieces each bearing an outline of a predetermined design thereon to respective ones of a plurality of fabric pieces, cutting each fabric piece and adhered backing piece along the outline into the predetermined design of the respective backing piece to form respective quilting pieces, placing two quilting pieces which are to be joined in an overlapping relationship with the edge portions of the two quilting pieces which are intended to be joined adjacent to each other and, in the case of curved edge portions, confronting each other, temporarily securing the two quilting pieces together along a predetermined seam line, and sewing the two quilting pieces together along the seam line. Additional quilting pieces are applied to the two fabric pieces in like manner. The fabric pieces are overlapped face to face and one of the quilting pieces becomes folded over itself after the two quilting pieces are temporarily secured. The sewn pieces are straightened into a coplaner relationship, for example, by ironing.

As disclosed, the backing pieces are adhered to the fabric pieces by means of an adhesive which is heat-activated, heat being applied to the backing piece by means of a warm iron, for example. The quilting pieces are temporarily secured, for example, by pinning or tacking the pieces together.

According to one aspect of the invention, a sheet of synthetic material is provided having adhesive, preferably a heat-activated adhesive, applied to one face thereof and bearing on the opposed face a plurality of outlines of one or more predetermined designs. The sheet can be cut into a plurality of backing pieces in a predetermined design or which bear an outline of a predetermined design. The backing pieces can be adhered to fabric pieces as described herein and sewn together to form a quilt.

The sheet bears within each of the outlines a seam line along which fabric pieces and adhered backing pieces are intended to be sewn and further a center mark on each seam line indicating the approximate center of the seam line. The sheet can also bear within each of the outlines, another similar outline with corresponding portions of the outlines extending parallel to each other. Each of the outlines is preferably spaced on the sheet so as to allow cutting of backing pieces with each bearing a respective outline.

These and other aspects of the present invention will be more apparent from the following description of the preferred embodiment thereof when considered with the accompanying drawings.

BRIEF DESCRIPTION OF THE DRAWINGS

The present invention is illustrated by way of example and not limitation in figures of the accompanying drawings in which like references indicate similar parts and in which.

DESCRIPTION OF THE PREFERRED EMBODIMENT

Figure 1:
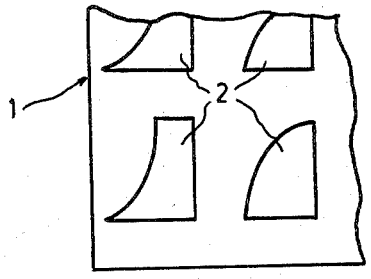
FIG. 1 shows a portion of a sheet of backing material according to the invention.

Initial steps in the process of this invention involve firstly the supply of a sheet 1 of backing material, for example as shown in FIG. 1, having one face coated, at least in part, by a heat-sensitive or heat-activated adhesive. The backing material may be chosen from any of the range of coarse woven or non-woven, compressed, bonded synthetic materials presently available, of which "VILENE" is an ideal material. A plurality of outlines 2 of one or more predetermined designs are printed, or impressed upon the face of the backing material opposite the coated surface. Preferably, a uniform marginal edge portion (FIG. 2) is defined about the perimeter of each design by an inner line parallel with the outline. Each individual design outline is separated, for instance by cutting, from the sheet of backing material and applied by the application of a heated iron to the back of a selected fabric piece. Both the backing material and the fabric are then cut to the shape of the design outline.

Figure 2:
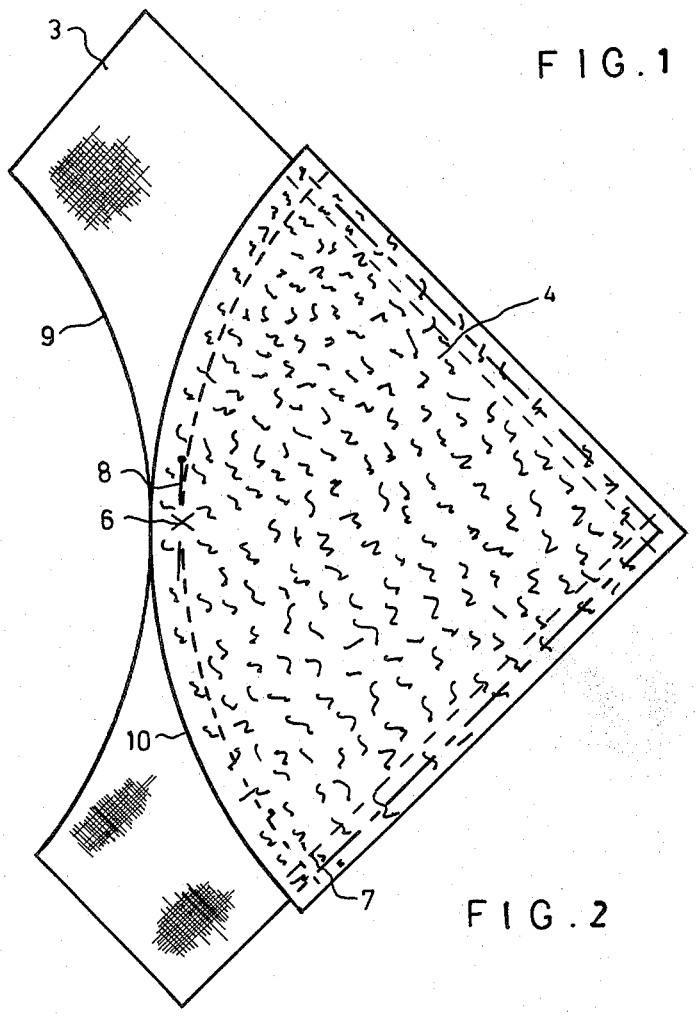
FIG. 2 shows two fabric pieces about to be pinned along intended adjacent curved edges.
Figure 3:
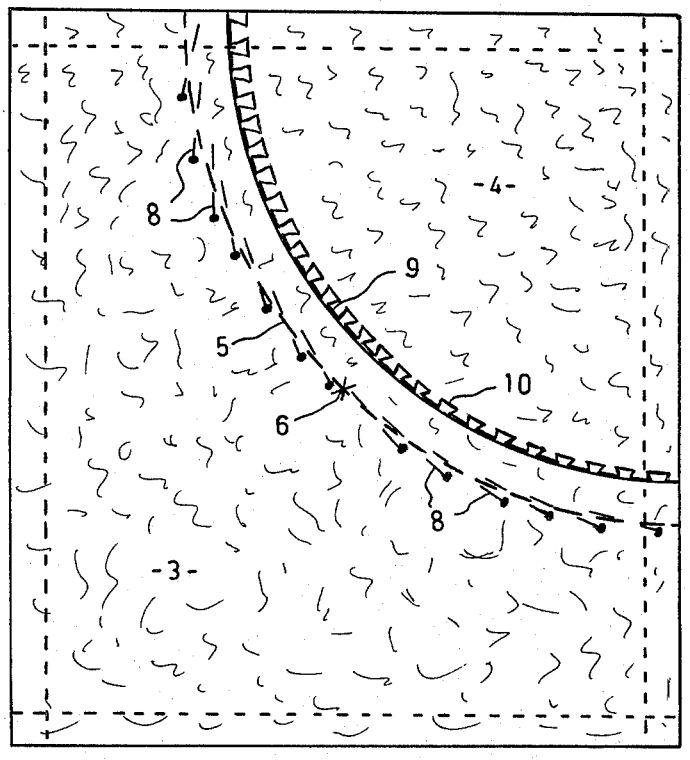
FIG. 3 shows the two pieces of FIG. 2 after completion of the pinning step.

FIG. 2 shows the next step in the process where two intended adjacent fabric pieces 3 and 4 are placed one upon the other and face to face. It is intended to join the two pieces 3 and 4 along a seam line 5 shown in FIG. 3. The center mark 6 is also printed upon the backing material on the curved guide line 7. It will be appreciated that a similar guide line is provided adjacent the concave edge of the fabric piece 3 on the back thereof as viewed in FIG. 1. A pin 8 is inserted through the two pieces on the guide line 7 when the center marks 6 on both pieces 3 and 4 correspond in position. The outer ends of the two curved surfaces 9 and 10 are then pinned together on the guide lines 7 and further pins inserted between these extreme positions. During this operation it will be found that the marginal edge portion of the underlying piece 3 or 4, will become folded back upon itself. It is not important whether the convex or the concave edge portion is so folded, but it will be noticed that the folded edge portion will appear puckered.

A sewing machine may now be employed to sew along the seam line 5 after which the pins 8 are removed and the two pieces 3 and 4 are flattened into coplaner relationship. If then pressed with a warm iron it will be found that a minimum of puckering along the seam line 5 has occurred. If fact, it is quite surprising how little puckering has occurred and this quite obviously has resulted mainly due to the use of the backing material. It has also been found that far less stringent requirements are imposed on the tension of the sewing machine upon the fabric apparently due to the use of the backing material. Furthermore, the provision of seam lines 7 ensure more uniform assembly of pieces 3 and 4 thus reducing the chance of accumulative errors detracting from the appearance of the finished quilt.

Further pieces may then be added in similar manner to the exposed sides of the joined pieces 3 and 4 subsequently to obtain a completed quilting piecework. It will be obvious that straight edges or edges of almost any shape may be joined together by a puckerless seam by following the above technique. By practising this invention it has been found that considerably less skill is required to achieve a well constructed piecework than has hitherto been possible.

Whereas a preferred embodiment has been described in the foregoing passages it should be understood that other forms, modifications and refinements are feasible within the scope of this invention. It will be appreciated that besides being directed to a method of producing quilting piecework, the invention also includes the provision of backing material prepared for use in the said method.

What is claimed is:

1. A method of forming quilting piecework comprising the steps of:

adhering a plurality of backing pieces each bearing an outline of a predetermined design thereon to respective ones of a plurality of fabric pieces, cutting each fabric piece and adhered backing piece along the outline into the predetermined design of the respective backing piece to form respective quilting pieces, placing two quilting pieces in an overlapping relationship with the fabric pieces face to face and the edge portions of the two quilting pieces which are intended to be joined adjacent to each other, temporarily securing the two quilting pieces together along a predetermined seam line, with one of the quilting pieces being folded over itself after the two quilting pieces are temporarily secured, sewing the two quilting pieces together along said seam line, and straightening the sewn pieces into a coplaner relationship.

2. The method according to claim 1 and including the steps of placing, temporarily securing, sewing and straightening, as recited, respective additional quilting pieces to a respective one of the sewn together quilting pieces.

3. The method according to claim 1, wherein the backing pieces are adhered to the fabric pieces by means of an adhesive.

4. The method according to claim 3, wherein the adhesive is heat-activated and the backing pieces are adhered to the fabric pieces by the application of heat to the backing piece.

5. The method according to claim 1, wherein the quilting pieces are temporarily secured by pinning or tacking the pieces together.

6. The method according to claim 1 or 2, wherein the sewn pieces are straightened by ironing.

7. The method according to claim 1 and including the further steps of providing a sheet having a plurality of backing pieces thereon and separating the backing pieces from the sheet.

8. The method according to claim 7, wherein the backing pieces are separated from the sheet by cutting.

9. The method according to claims 1 or 2, wherein the predetermined design outline of two of the quilting pieces to be sewn each include a curved portion along which the two quilting pieces are to be joined, the two quilting pieces being overlapped with the curved portions confronting each other.

* * * * *